US008272623B2

(12) United States Patent
Draxl et al.

(10) Patent No.: US 8,272,623 B2
(45) Date of Patent: Sep. 25, 2012

(54) CONTAINER LIFTING DEVICE

(76) Inventors: Andres Joseph Draxl, Gauteng (ZA); Henry Jansen Van Rensburg, Gauteng (ZA)

( * ) Notice: Subject to any disclaimer, the term of this patent is extended or adjusted under 35 U.S.C. 154(b) by 528 days.

(21) Appl. No.: 12/306,967

(22) PCT Filed: Jul. 3, 2007

(86) PCT No.: PCT/IB2007/001819

§ 371 (c)(1),
(2), (4) Date: Dec. 30, 2008

(87) PCT Pub. No.: WO2008/004083

PCT Pub. Date: Jan. 10, 2008

(65) Prior Publication Data

US 2009/0315004 A1 Dec. 24, 2009

(30) Foreign Application Priority Data

Jul. 3, 2006 (ZA) ..... 2006/05448

(51) Int. Cl.

| | |
|---|---|
| ***B66F 7/26*** | (2006.01) |
| ***B66F 7/12*** | (2006.01) |
| ***B66F 7/16*** | (2006.01) |
| ***B60P 1/48*** | (2006.01) |
| ***E02C 3/00*** | (2006.01) |

(52) U.S. Cl. ..... 254/45; 254/47; 254/88; 254/49; 254/89 R; 254/10 C; 254/93 L

(58) Field of Classification Search ..... 254/45, 254/88, 47, 49, 50, 89 R, 10 C, 2 C, 91 L
See application file for complete search history.

(56) References Cited

U.S. PATENT DOCUMENTS

| | | | | |
|---|---|---|---|---|
| 3,773,199 | A * | 11/1973 | Arvidsson | 414/498 |
| 3,865,346 | A * | 2/1975 | Shirk | 254/89 R |
| 5,333,434 | A * | 8/1994 | Oberman et al. | 52/645 |

FOREIGN PATENT DOCUMENTS

| | | |
|---|---|---|
| DE | 75 02 135 U | 6/1975 |
| GB | 2 093 806 A | 9/1982 |
| GB | 2 204 024 A | 11/1988 |

* cited by examiner

*Primary Examiner* — Monica Carter
*Assistant Examiner* — Seahee Yoon
(74) *Attorney, Agent, or Firm* — Morgan Lewis & Bockius LLP

(57) ABSTRACT

A lifting device for lifting a shipping container off a flat bed of a truck is described. The device comprises a cross member and a pair of arms connected thereto. The upper ends of the arms engage in the connector castings at the upper end of an end of the container. The cross member carries near its ends a pair of guides through which a pair of legs are slidably mounted. The upper end of each leg has an outwardly directed lug. A block and tackle unit is connected between the lug and the cross member. There is a lifting device at each end of the container. When the unit is actuated the container is lifted off the flat bed so that the truck can move away and the container thereafter lowered on to the ground.

13 Claims, 8 Drawing Sheets

CONTAINER LIFTING DEVICE

This is a U.S. National Phase Entry of PCT Application No. PCT/IB2007/001819, filed Jul. 3, 2007, with a priority date of Jul. 3, 2006, based upon Application No. ZA 2006/05448 filed in South Africa.

FIELD OF THE INVENTION

This invention relates to shipping containers.

BACKGROUND OF THE INVENTION

A shipping container is normally a parallipipedal unit formed by a frame that is clad with steel walls with an openable part or door at one of its ends. Shipping containers are normally of the following dimensions viz 6.1 m or 12.2 m in length, 2440 mm in width and 2590 mm in height. There are similarly dimensioned shipping containers which are an additional 310 mm in height (called herein "high containers"). The shipping container has connector castings at its corners whereby it may be secured to adjacently stacked containers and also for lifting and other handling purposes.

Shipping containers are usually transported by ship, by flat bed rail cars and trucks. At their ultimate destination the shipping containers are unloaded for unloading, possible reloading and also for possible short term storage purposes.

This invention is concerned with container loading and off-loading devices.

Many different systems have been designed and used for loading containers on and off trailers. Most of the known systems require cranes or gantries or sophisticated hydraulic lifting devices such as grapples.

A problem that has been experienced is that often it is necessary to load or off-load containers from trucks in remote areas where cranes, gantries or the like are not available.

SUMMARY OF THE INVENTION

According to one aspect of the present invention there is provided a loading device for a shipping container comprising a frame including a horizontal cross-member which is longer than the width of a container which in use is located at the lower end of an end of the shipping container;

a pair of arms having upper and lower ends, the lower end of each arm being connected to the ends of the cross-member, the upper ends of the arms being adapted to engage the connector castings at the upper corners of the same end of the shipping container;

a pair of legs having ground engaging means at their lower ends and being slidably connected to cross-member respectively;

lifting means having upper and lower connecting means;

upper connecting devices adapted to be connected to a first part of a lifting means, each said connecting device being connected to the upper end of each leg; and lower connecting means on the cross-member at locations below the upper connecting devices and each being adapted to engage a second part of the lifting means.

There are preferably lifting means provided each with one part connected to an upper connecting device and the other part connected to the lower connecting means. Preferably the lifting means comprises a block and tackle unit. It is desirable for an outwardly extending lug to be provided at the upper end of each leg to carry respectively the upper connecting devices.

Such devices conveniently may comprise a member having at its end an eye that may be engaged by a hook or similar part attached to the lifting means.

Each leg preferably has transverse openings therethrough into which stops may be introduced to support the container at any desired height.

According to another aspect of the invention there is provided the combination of a shipping container having connector castings at the corners of each end and a pair of lifting means as set forth above located at each end in the following manner, viz the said upper ends of the arms of each device are connected to the connector castings at the upper end of each end of the container, the cross-members are located at the lower ends of the ends of the container and lifting means are introduced with one part of each lifting means connected to an upper connecting device and the other part connected to the cross-member at the said location, whereby on actuating the lifting means the container may be raised in such a manner that it is carried by the legs to enable the truck on which the container was carried can move away from the container and thereafter the container can be lowered on to the ground. The lifting means may also be able to lift the container when it is desired to load it on to a flat bed truck, and the truck is moved so that the container is under the flat bed and then lowered on to the flat bed.

An intermediate member is preferably connected to the lower connector castings at each end of the container and connection means are provided which connect the intermediate member to the cross-member so that the location of the container relative to the legs may be varied to compensate for mislocation of the truck under the container when the flat bed of the truck is driven into position under the container.

An embodiment of the invention will now be described by way of example with reference to the accompanying drawings.

DETAILED DESCRIPTION OF THE INVENTION

Figure 10:
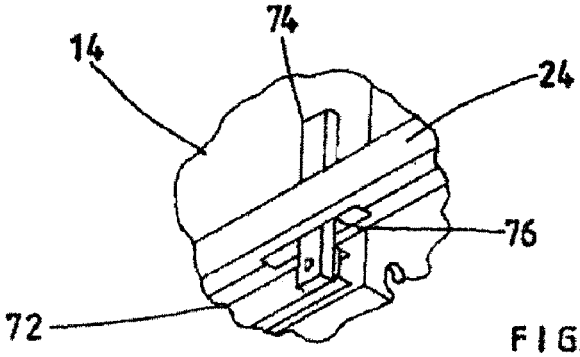
FIG. 10 is an enlarged detail of FIG. 4.
Figure 11:
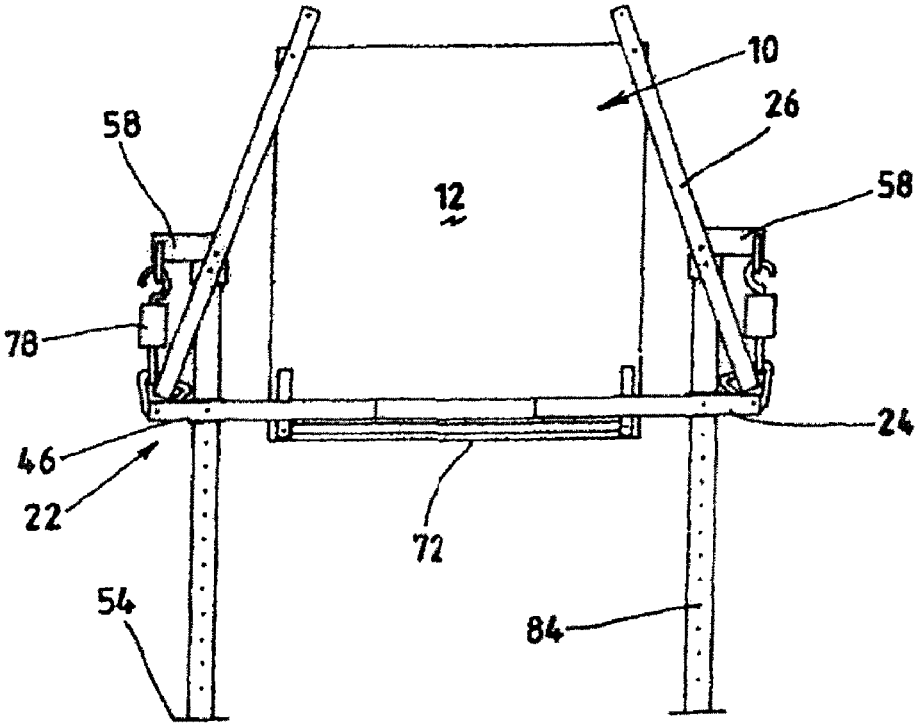
FIG. 11 is a rear view of the container suspended on the lifting devices.

Referring now to the drawings, there is shown a shipping container 10. The container 10 is a parallelipipedal unit which is 12.2 m long, 2.59 meters high and 2.44 meters wide. At the corner of each end 12 and side 14 the container 10 has a connecting casting (shown diagrammatically in FIG. 10)

whereby the container 10 may be lifted or connected to adjacent containers in a container ship. The container 10 is shown in FIGS. 1 to 4 having been lifted up above the flat bed 18 of a truck 20 which has transported it, the shipping container 10, from a first location to a delivery location. The truck 20 is shown diagrammatically in the drawings.

At each end 12 of the container 10 is a lifting device 22 of the invention. The lifting devices 22 serve the following purposes as will be described viz (i) lifting the container off the flat bed 18 so that the truck 20 may move elsewhere for further use and then (ii) for lowering the container 10 on to the ground. The lifting device 22 comprises a frame consisting of a cross-member 24, a pair of arms 26, and a pair of legs 28.

Figure 8:
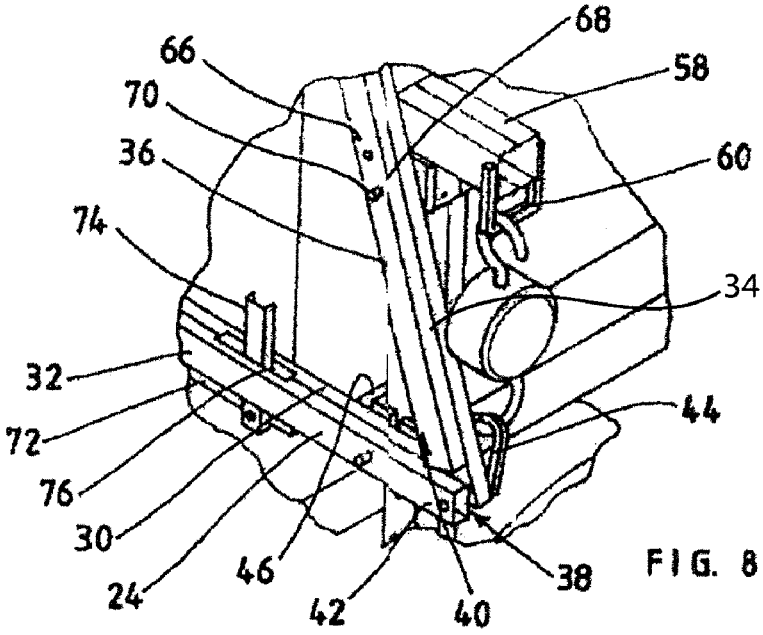
FIGS. 8 and 9 are enlarged details of FIG. 1.

The cross-member 24 is located at the lower end of the end 12 of the container 10 and extends beyond either side thereof. The cross-member 24 is connected to the container 10 as will be described below. The cross-member 24 as well as the arms 26 comprise inner and an outer box section members respectively 30 and 32 and 34 and 36. At each end 38 the inner box section member 30 of the cross-member 24 terminates short of the outer member 32. At its lower end 40 of each arm, the outer box member 36 terminates short of the inner box member 34 (best shown in FIG. 8). The inner surfaces of the inner box member 34 and the outer member 32 where these extend beyond their adjacent box members 34 and the outer member 32 where these extend beyond their adjacent box members bear against each other and a connector pin 42 passes through each pair of parts so that the lower ends of the arms 26 are pivotally connected to the ends of the cross-member 24.

Figure 9:
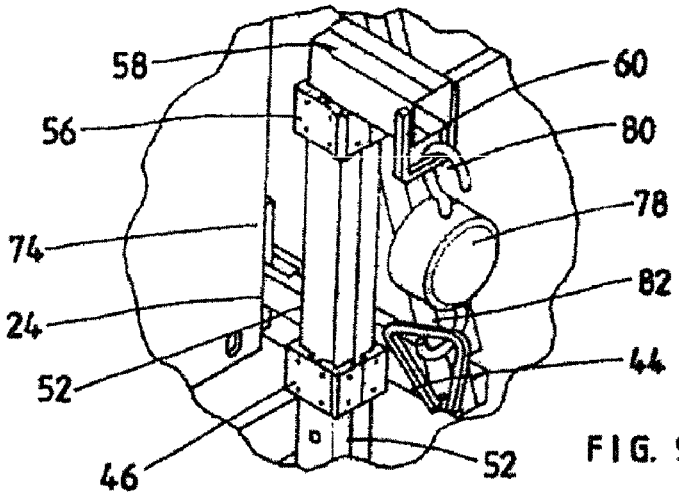

The pins 42 extend beyond the cross-member 24 and engage in one corner of a triangular connector 44 (best shown in FIG. 9). A suitable securing plate not shown) is provided to hold each connector 44 on to the pin 42.

A robust square section vertical guide 46 is bolted on to the cross-member 10 spaced inwardly of each of its ends. A vertical leg 28 comprising two rectangular box section members 52 is slidably mounted in each guide 46. At its lower end, each leg 28 has a cross plate 54 forming a ground engaging foot. At its upper end each leg 28 has a reinforcing sleeve 56 above which is an outwardly extending box section lug 58 that terminates above the corresponding end of the cross-member 10. A "U" shaped shackle 60 is connected to the lower end of each lug 58.

The upper end of each arm 24 has a pair of inner and outer spaced openings 62 and 64. Attachment members (not shown) pass through the inner openings 62 and engage the connector castings 16. Near its lower end, each arm 24 further has a pair of upper and lower openings 66 and 68. A pin 70 projects from the sleeve 56 through the lower opening 68 to connect the sleeve 56 to the arm 24.

An intermediate member 72 runs along the lower portion of each end 12 and is connected to the lower connector castings. A pair of upwardly extending, vertical, channel-shaped members 74 (best shown in FIG. 10) are carried by the intermediate vertical member 74 at a location close to the ends of the container 10. The cross-member 24 has a longitudinal slot 76 near each end through which the member 72 passes. This arrangement serves two purposes. First, it holds the cross-member 24 close to the container 10. Second, it enables the cross-member 24 to move longitudinally for the purposes which will be described.

A block and tackle unit 78 is provided between each lug 58 and the end of the cross-member 24. The unit 78 has upper and lower connecting hooks 80 and 82 which engage respectively the shackle 60 and the triangular connector 44.

The legs 28 have cross-bores 84 through which carrier pins (not shown) can pass to hold the container 10 in a position raised relative to the feet 54 if so required, A set of low friction plastic liners 86 (see FIG. 1) are provided on the insides of the guides 46 to permit easy movement of the legs 28 therethrough.

Figure 5:
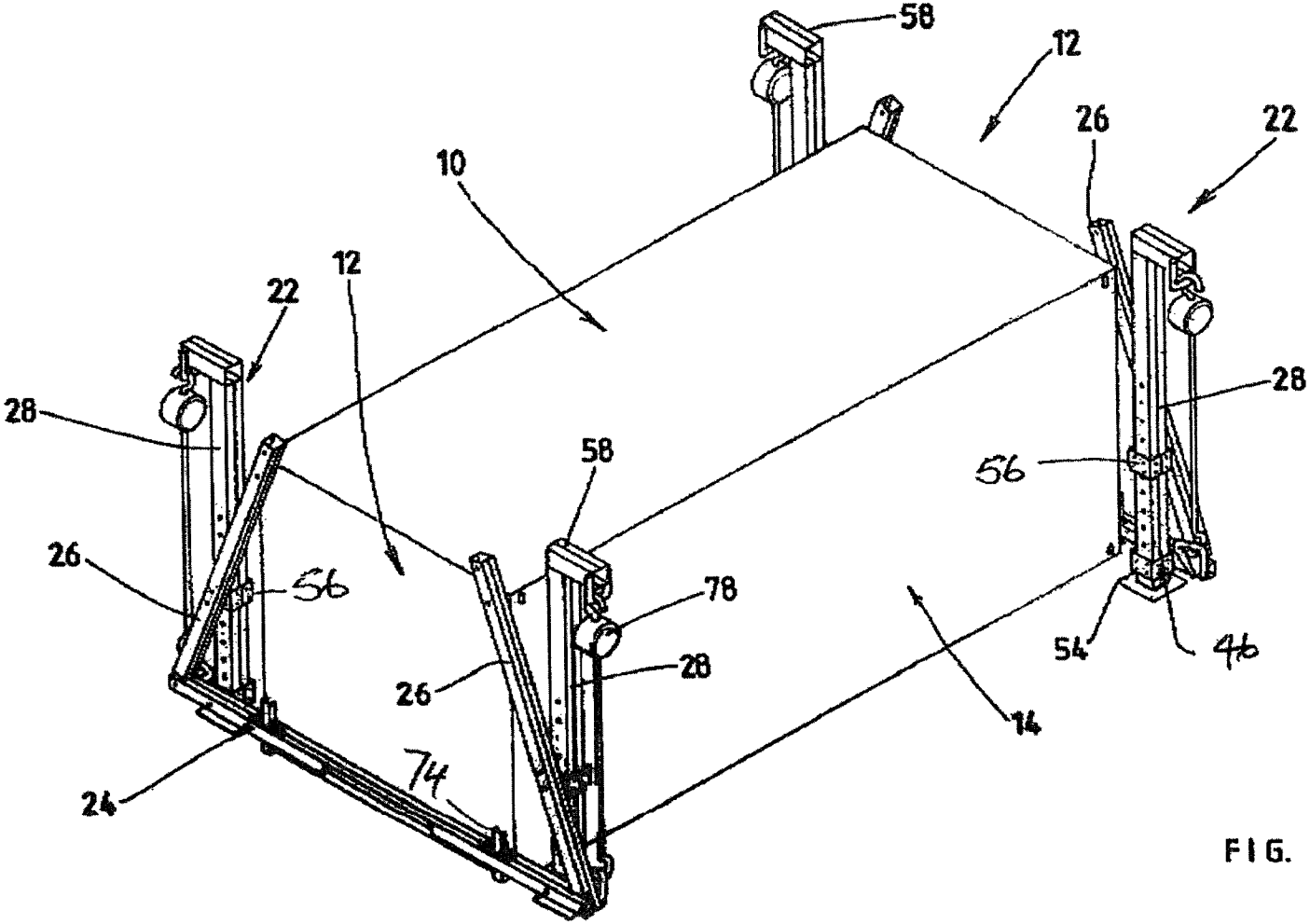
FIG. 5 is a perspective view similar to FIG. 1 showing the container and lifting devices when the container is lowered on to the ground.
Figure 6:
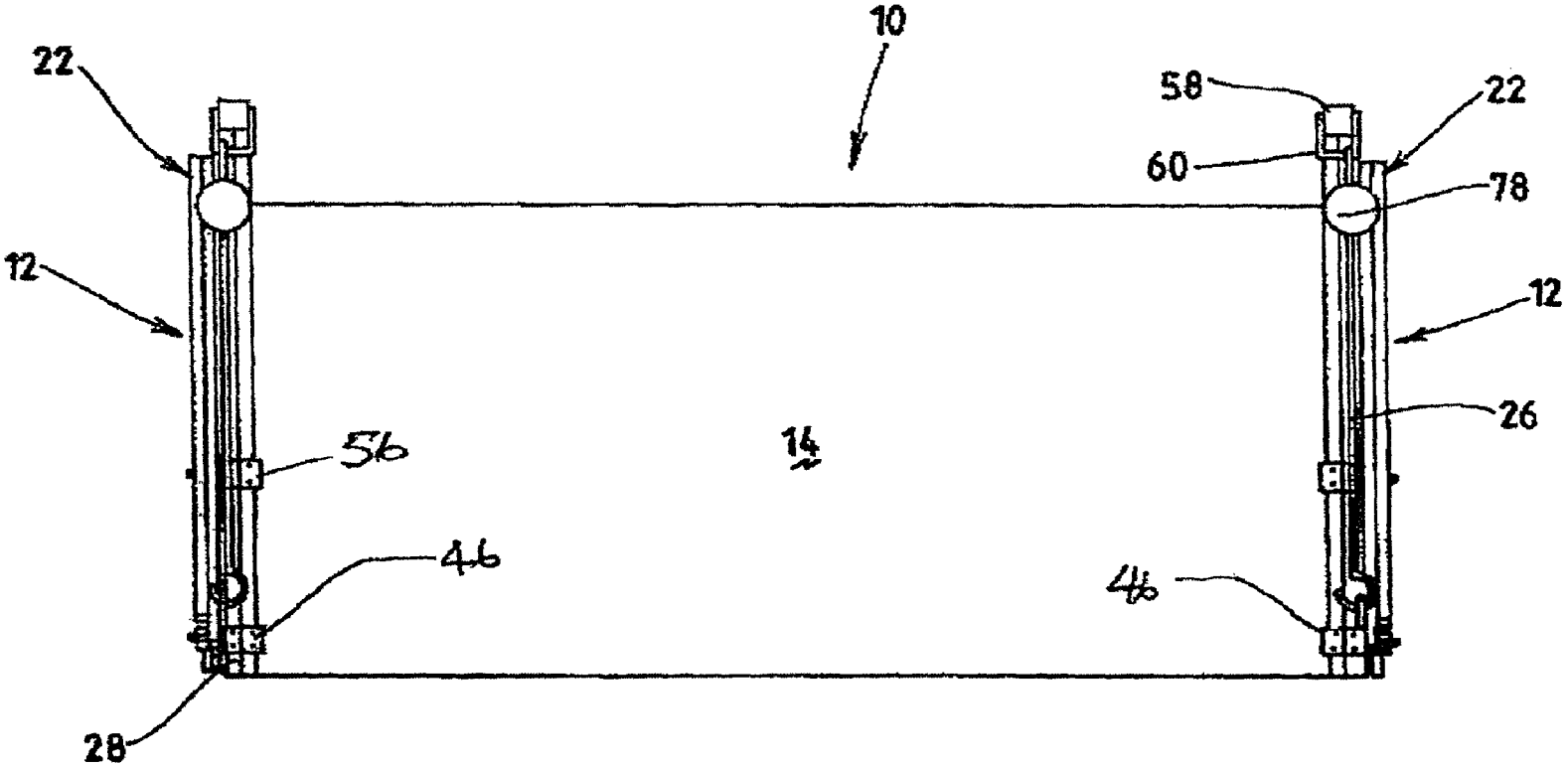
FIG. 6 is a side view of the parts as shown in FIG. 5.
Figure 12:
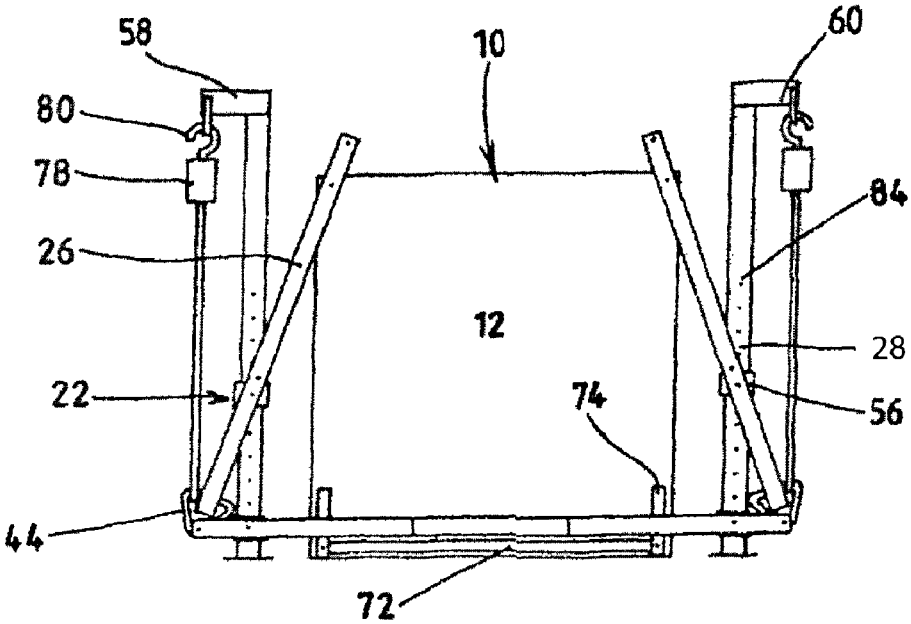
FIG. 12 is a rear view showing the container lowered on to the ground.

The lifting device 22 operates as follows. The various parts are connected as above described to a container 10 on a flat bed 18 of a truck 20. The block and tackle units 78 are operated to draw the cross-member 24 upwardly and hence to lift the container 10 off the flat bed 18. When there is sufficient clearance the truck 20 can then be driven away. By means of the block and tackle units 78, the container 10 is lowered on to the ground as shown in FIGS. 5, 6 and 12. The container can being be unloaded and otherwise used e.g. as a short-term storage device or it can be loaded with reverse cargo.

The re-positioning of the container 10 on the flat bed 18 follows substantially the reverse operations to those mentioned above. The lifting devices 22 are brought to the ends of the container 10 and connected as mentioned above. By means of the block and tackle units 78 the container 10 is lifted to an appropriate height. The truck 20 is now carefully manoeuvred into position so that the flat bed 18 is properly aligned with the container 10 which is now lowered thereon. The container 10 is secured to the flat bed 18. The block and tackle units 78 are manipulated so that the lifting devices 22 are no longer subject to the weight of the container 10 and are then removed from the container 10 and stored. The truck 20 can now transport the container 10 to its desired destination.

Figure 1:
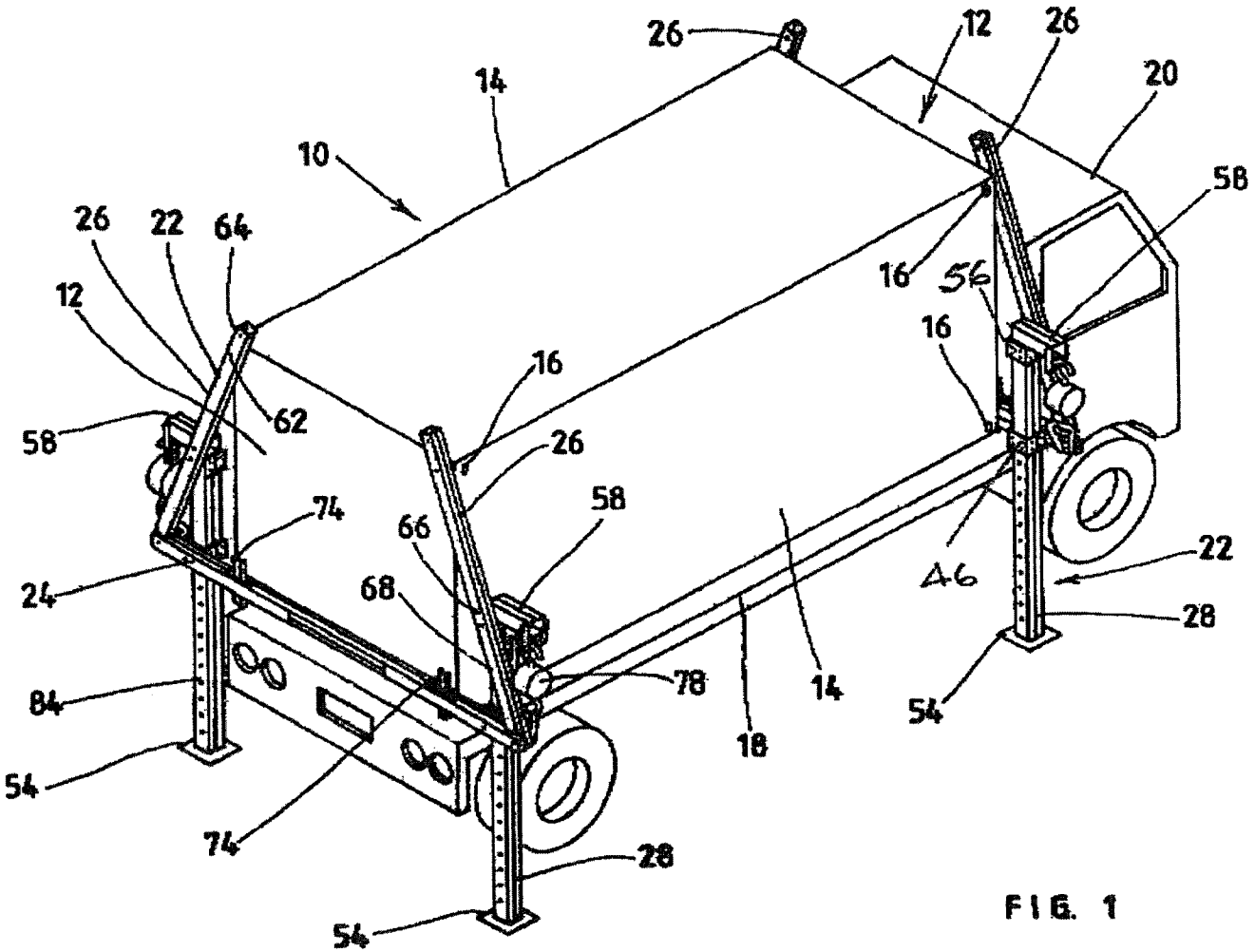
FIG. 1 is a perspective view from the rear and above of a flat bed truck with a container lifted slightly off the flat bed of the truck by a pair of lifting devices of the invention.
Figure 2:
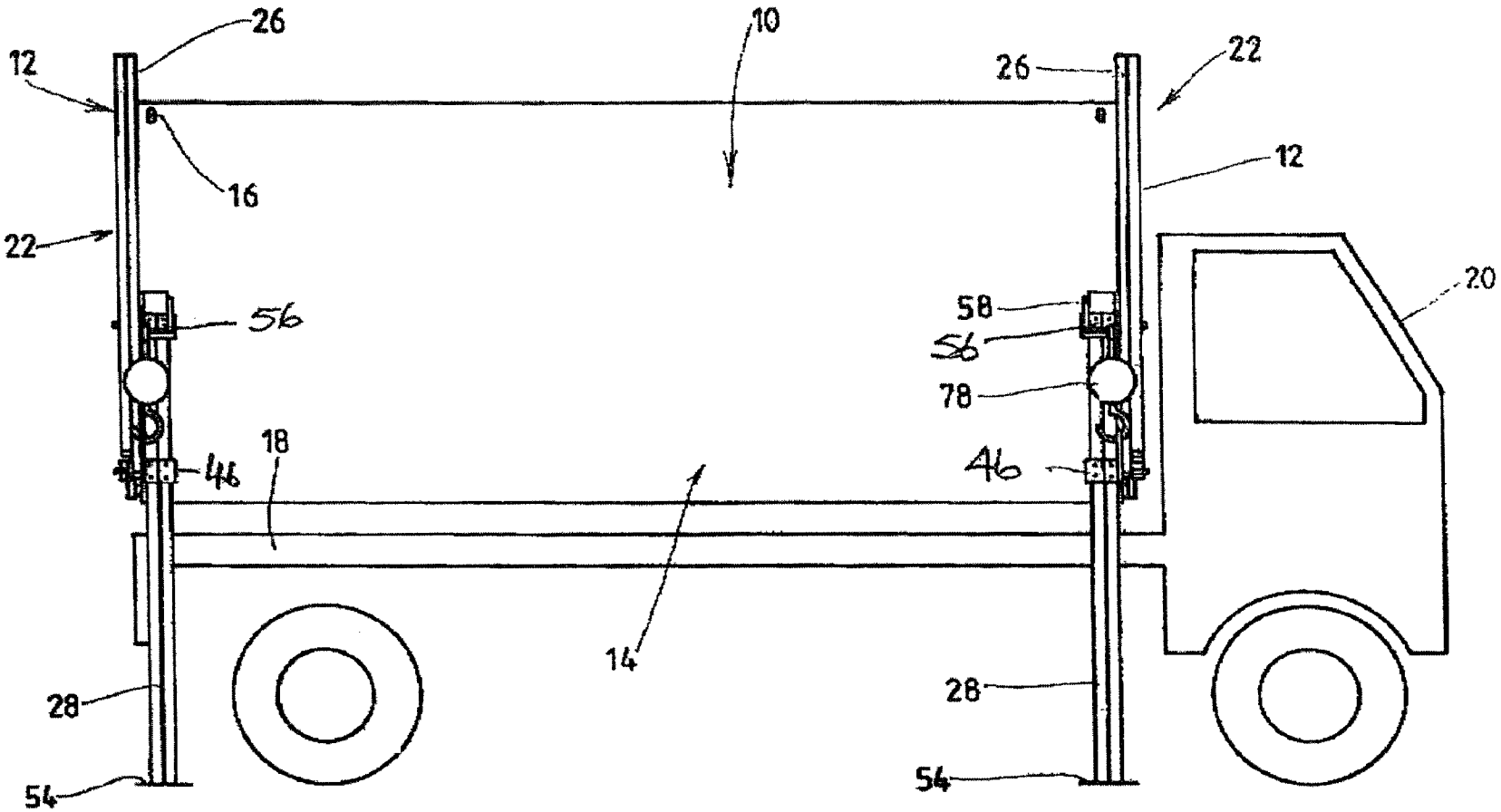
FIGS. 2, 3 and 4 are respectively a side view, a rear view and a perspective view from the rear and below of the parts shown in FIG. 1.
Figure 3:
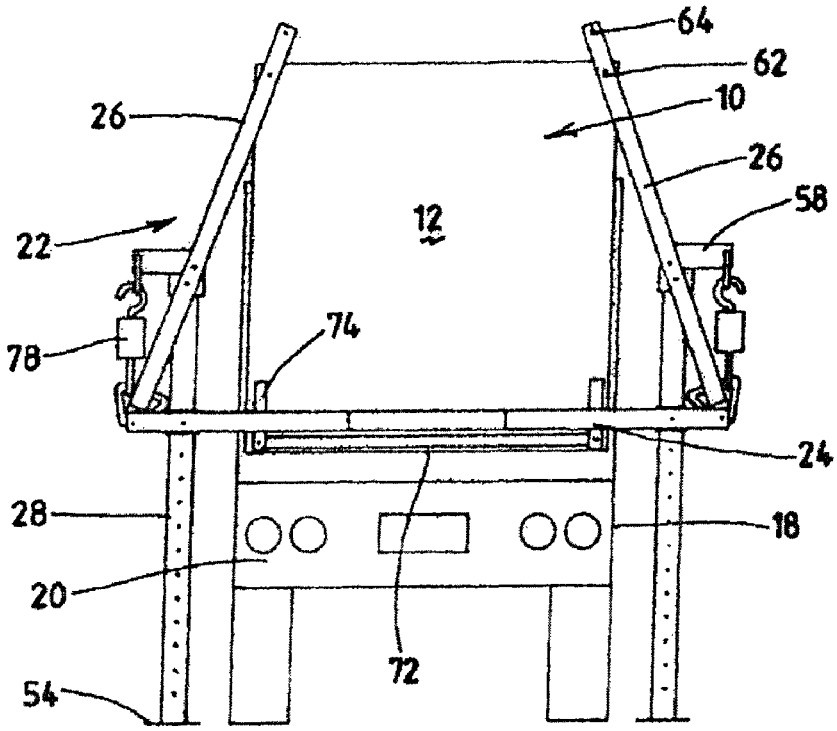
Figure 7:
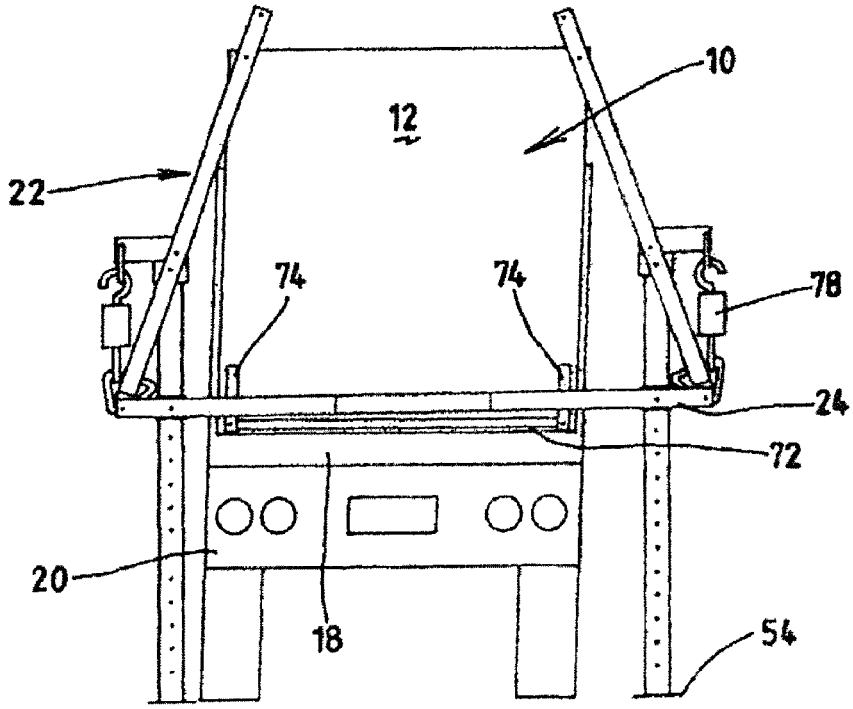
FIG. 7 is a rear view of the container being lowered on to the flat bed of the truck where the latter is slightly misaligned.
Figure 4:
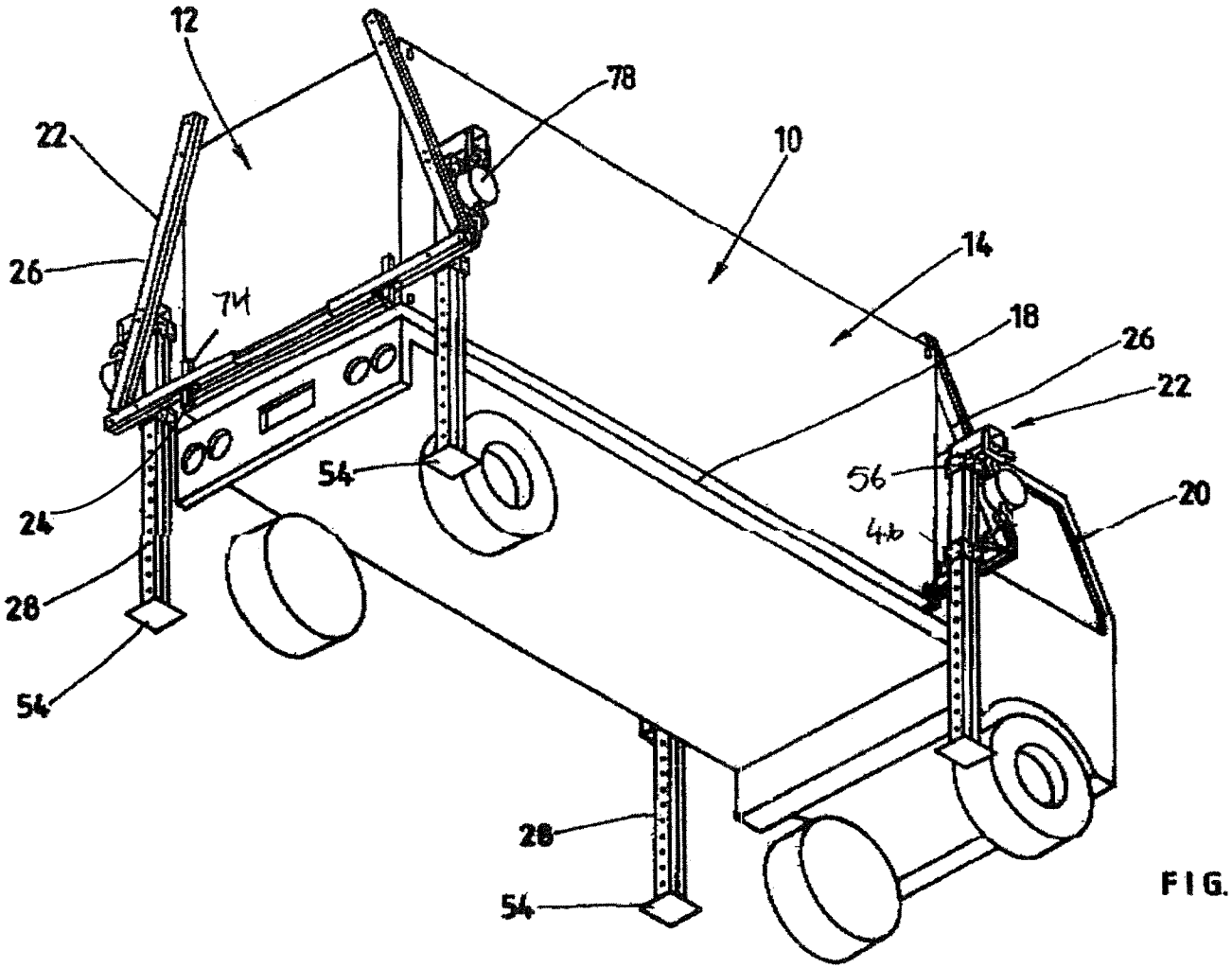

In the event that the truck 20 is not precisely located below the container 10, the container 10 is man-handled sideways swinging on the upper connector castings 16 until the container 10 is correctly located above the flat bed 18 (as shown in FIG. 7). The container 10 is then lowered. During this movement of the container 10 the upright channel shaped members 74 move within the slots 76.

The lifting devices 22 are used in the same manner when the container is a high container (as defined above) save as follows: The pins 70 are passed through the upper openings 64 in the arms 26. The attachment means connect the upper openings 64 to the connector castings at the upper end of the container 10.

The legs 28 are extremely robust and may desirably be sufficiently strong so that each can carry a mass of ten tonnes even though the mass of the container 10 and its contents is normally no more than twenty two tonnes or on rare occasions (where the shipper has to pay financial penalties) as much as twenty five tonnes. The extra strength of the legs may be necessary where the ground, is uneven and more weight must be carried by one of the legs than the others.

It will be noted that the configuration of the cross-member, the arms and the upper part of the container form a substantially rigid load carrying framework. This enables the lifting devices to be sufficiently strong enough to lift heavy containers whilst comprising a cross-member and arms which are relatively light and can easily be manhandled for assembly and removal. The legs too and other parts of the lifting devices can easily be lifted by work men for assembly and removal. The disassembled lifting devices can be stored on the flat bed of the truck (which will have suitable arrangements to secure the parts) or in the containers when not in use or may be transported for use in a light delivery truck or van.

It will be appreciated that a lifting device 22 as described in this invention is required on each end of a container. The lifting device 22 is per force relatively lightweight as little or no bracing is required.

This invention is not limited to the precise constructional details as hereinbefore described and illustrated in the drawings. For example the cross-member and arms, as well as the legs, may comprise non-square section members e.g. cylindrical units. Other lifting devices may be used.

The invention claimed is:

1. A lifting device for a shipping container having rectangular sides and ends and a top and bottom, the lifting device comprising a frame including a horizontal cross-member having ends, the distance apart of which is longer than the width of the ends of the container, the cross-member having means to be connected to the lower end of one end of the container, a pair of rigid arms each having upper and lower ends, the lower end of each arm being connected to one end of the cross-member, the upper ends of the arms being adapted to engage the upper corners of the said one end of the shipping container respectively so that the arms are inclined towards each other at their upper ends, a pair of legs having ground engaging means at their lower ends and being slidably connected to the cross-member respectively, a pair of lifting means each having upper and lower connecting means;

the upper connecting means being connected respectively to the legs and the lower connecting means being connected to the cross-member at locations below the upper connecting means, the arrangement being such that when the horizontal cross-member is lifted upwardly, the rigid arms can lift the container.

2. The lifting device as claimed in claim 1 wherein the lifting means comprises a block and tackle unit.

3. The lifting device as claimed in claim 1 wherein the cross-member carries a plurality of vertical guides in which the legs are slidably mounted.

4. The lifting device as claimed in claim 1 further comprising an intermediate member which is adapted to be connected to the lower connector castings and which carries means engaging the cross member in such a way that the cross member can move longitudinally relative to the intermediate member so that the location of the container relative to the legs may be varied to compensate for mislocation of a flat bed of a truck under the container when the flat bed of the truck is driven into position under the container.

5. The lifting device as claimed in claim 4 wherein the cross member is provided with longitudinal slots therein and wherein the said carry means comprise members carried by the intermediate member and being slidably received within the slots.

6. The lifting device as claimed in claim 1 wherein each of the legs is provided with an outwardly directed lug to which the upper connecting means may be connected.

7. The lifting device as claimed in claim 6 wherein the outer end of the lug has a shackle attached thereto to which the upper part of the lifting means may be removably connected.

8. The lifting device as claimed in claim 6 wherein each arm is connectable to the leg above the cross member.

9. The lifting device as claimed in claim 1 comprising a pin connected at each end of the cross member to the lower end of the associated arm.

10. The lifting device as claimed in claim 9 wherein the pin carries a shackle to which the lower connecting means may be connected.

11. The combination of two lifting devices as claimed in claim 1 with a shipping container having connector castings at the corners of its ends, wherein the said upper ends of the arms of each device are connected to the connector castings at the upper end of each end of the container, the cross-members are located at the lower ends of the container and a plurality of lifting means are provided with one part of each lifting means connected to an upper connector casting and the other part connected to the cross-member at the said location, whereby on actuating the lifting means the shipping container when mounted on a flat bed of a truck may be raised off the flat bed in such a manner that it is carried by the legs to enable the truck to move away from the container and thereafter the container can be lowered on to the ground.

12. A lifting device for loading a shipping container from a truck or lorry, which shipping container has rectangular sides and ends and a top and bottom, the lifting device comprising a cross member with ends which are spaced apart by a greater distance than the width of the container, connector means at the ends of the cross member connection devices between the ends of the cross-member whereby the cross-member may be connected to the lower part of the shipping container first and second arms each having a lower end and an upper end, the lower ends of the first and second arms being respectively hinged to the connector means having first connection means at one end which are hingedly connected respectively to the connector means, the arms further having second connection means at their upper ends to be hingedly secured to an upper connector casting, the arms being inclined inwardly towards each other at their upper ends;

supporting legs slidably carried by the cross-member in board of the ends of the cross-member but spaced apart by a distance greater than the width of the container, and lifting means connected between the supporting legs and the cross-member to move the cross member and being actuable to move the cross member up and down the supporting legs thereby causing the arms to lift or to lower the container.

13. The lifting device as claimed in claim 12 wherein the lifting means comprises a block and tackle unit.

* * * * *